US008146845B2

(12) United States Patent
Chen

(10) Patent No.: US 8,146,845 B2
(45) Date of Patent: Apr. 3, 2012

(54) AUTOMATIC SHREDDER WITHOUT CHOOSING THE NUMBER OF PAPER TO BE SHREDDED

(75) Inventor: Hsin-Hsiung Chen, Shanghai (CN)

(73) Assignee: Aurora Office Equipment Co., Ltd. Shanghai (CN)

( * ) Notice: Subject to any disclaimer, the term of this patent is extended or adjusted under 35 U.S.C. 154(b) by 0 days.

(21) Appl. No.: 12/509,709

(22) Filed: Jul. 27, 2009

(65) Prior Publication Data

US 2010/0032507 A1 Feb. 11, 2010

(30) Foreign Application Priority Data

Aug. 6, 2008 (CN) ..... 2008 2 0151690 U

(51) Int. Cl.
*B02B 7/02* (2006.01)
*B02C 23/00* (2006.01)

(52) U.S. Cl. ..... 241/100; 241/236; 241/225

(58) Field of Classification Search ..... 241/100, 241/236, 224, 225
See application file for complete search history.

(56) References Cited

U.S. PATENT DOCUMENTS 606,596 A 6/1898 Stirckler
3,111,800 A 11/1963 Quianthy
3,629,530 A 12/1971 Fischer
(Continued)

FOREIGN PATENT DOCUMENTS

CN 2372057 4/2000
(Continued)

OTHER PUBLICATIONS

Andrew J. Scarlett et al., Guard interlockling for self-propelled harvesting machinery, Silsoe Research Institute, HSE Book 2002.

(Continued)

*Primary Examiner* — Bena Miller
(74) *Attorney, Agent, or Firm* — Wang, Hartmann, Gibbs & Cauley, PLC; John F. O'Rourke

(57) ABSTRACT

The present invention relates to an automatic shredder without choosing the number of paper to be shredded which comprises a shredder core and an automatic paper feeding device, the automatic paper feeding device comprises a driving mechanism, a paper support box, a pick-up mechanism and a paper press box, the driving mechanism is fixed on the shredder core and connected with the pick-up mechanism for driving the pick-up mechanism, the paper support box comprises a first zone and a second zone, the pick-up mechanism is positioned between the first zone and the second zone and fixed to the paper support box, and its paper feeding direction is towards the second zone, one end of the paper press box is pivoted with the paper support box, the other end of the paper press box is connected detachable with the paper support box, the paper support box is fixed on the shredder core, and the second zone has a paper inlet positioned above the blade assembly of the shredder core, a magnet is positioned in the first zone, the automatic shredder further comprises an elastic paper press and retaining device mounted inside the paper press box and extending to the first zone, the magnet corresponds to the elastic paper press and retaining device, so the present invention can deal with a very large amount of paper to be shredded at one time, has a simple and convenient operation, is designed dexterously, and has a concise structure and a economical cost.

8 Claims, 7 Drawing Sheets

U.S. PATENT DOCUMENTS 3,724,766 A 4/1973 Bosland
3,728,501 A 4/1973 Larson et al.
3,741,756 A 6/1973 Andersen et al.
3,746,815 A 7/1973 Drummer
3,769,473 A 10/1973 Lay
3,780,246 A 12/1973 Beckering et al.
3,785,230 A 1/1974 Lokey
3,829,850 A 8/1974 Guetersloh
3,860,180 A 1/1975 Goldhammer
3,873,796 A 3/1975 Worobec, Jr.
3,947,734 A 3/1976 Fyler
3,952,239 A 4/1976 Owings et al.
3,953,696 A 4/1976 Reimann et al.
3,971,906 A 7/1976 Sahrbacker
4,002,874 A 1/1977 Brown
4,016,490 A 4/1977 Weckenmann et al.
4,018,392 A 4/1977 Wagner
4,062,282 A 12/1977 Miller et al.
4,068,805 A 1/1978 Oswald
4,082,232 A 4/1978 Brewer
4,107,484 A 8/1978 Petersen, III
4,117,752 A 10/1978 Yoneda
4,125,228 A 11/1978 Brewer
4,135,068 A 1/1979 Burns
4,162,042 A 7/1979 Mommsen et al.
4,172,400 A 10/1979 Brierley
4,180,716 A 12/1979 Suzuki
4,187,420 A 2/1980 Piber
4,194,698 A 3/1980 Kosmowski
4,232,860 A * 11/1980 Brown ..... 271/119
4,262,179 A 4/1981 Bauer
4,276,459 A 6/1981 Willett et al.
4,277,666 A 7/1981 Vignaud
4,349,814 A 9/1982 Akehurst
4,423,844 A 1/1984 Sours et al.
4,449,062 A 5/1984 Wilson
4,471,915 A 9/1984 Levin et al.
4,510,860 A 4/1985 LaBarge et al.
4,518,958 A 5/1985 Cook et al.
4,545,537 A 10/1985 Kimura et al.
4,549,097 A 10/1985 Ulmer
4,562,971 A 1/1986 Schwelling
4,564,146 A 1/1986 Bleasdale
4,598,182 A 7/1986 Breslin
4,664,317 A 5/1987 Morton
4,673,136 A 6/1987 Bianco et al.
4,683,381 A 7/1987 Dufoug
4,693,428 A 9/1987 Raterman et al.
4,706,895 A 11/1987 Bricker
4,709,197 A 11/1987 Goldhammer et al.
4,713,509 A 12/1987 Chebowski
4,751,603 A 6/1988 Kwan
4,753,323 A 6/1988 Kahkipuro
4,767,895 A 8/1988 Parrish
4,771,359 A 9/1988 Link
4,784,601 A 11/1988 Nitta
4,784,602 A 11/1988 Nitta
4,798,116 A 1/1989 Silver et al.
4,821,967 A 4/1989 Moriyama
4,824,029 A 4/1989 Stottmann et al.
4,839,533 A 6/1989 Aga
4,859,172 A 8/1989 Nitta
4,882,458 A 11/1989 Berg et al.
4,890,797 A * 1/1990 Fujii et al. ..... 241/34
4,893,027 A 1/1990 Kammerer et al.
4,900,881 A 2/1990 Fischer
4,910,365 A 3/1990 Kuo
4,944,462 A 7/1990 Raterman et al.
4,982,058 A 1/1991 Schroeder et al.
5,037,033 A 8/1991 Stottmann et al.
5,044,270 A 9/1991 Schwelling
5,045,648 A 9/1991 Fogleman, Sr.
5,065,947 A 11/1991 Farnsworth
5,081,406 A 1/1992 Hughes et al.
5,100,067 A 3/1992 Konig et al.
5,135,178 A 8/1992 Strohmeyer
5,166,679 A 11/1992 Vranish et al.
5,167,374 A 12/1992 Strohmeyer
5,171,143 A 12/1992 Sohn
5,186,398 A 2/1993 Vigneaux, Jr.
5,207,392 A 5/1993 Stangenberg et al.
5,236,138 A 8/1993 Stangenberg et al.
5,268,553 A 12/1993 Shimoji
5,269,473 A 12/1993 Strohmeyer et al.
5,275,342 A 1/1994 Galanty
5,279,467 A 1/1994 Lydy
5,295,633 A 3/1994 Kimbro et al.
5,318,229 A 6/1994 Brown
D348,431 S 7/1994 Hoffman et al.
5,345,138 A 9/1994 Mukaidono et al.
5,356,286 A 10/1994 Sher
5,397,890 A 3/1995 Schueler et al.
5,407,346 A 4/1995 Sher
5,421,720 A 6/1995 Sher
5,432,308 A 7/1995 Howie, Jr.
5,436,613 A 7/1995 Ghosh et al.
5,460,516 A 10/1995 Sher
5,494,229 A 2/1996 Rokos et al.
5,568,895 A 10/1996 Webb et al.
5,607,295 A 3/1997 Khemarangsan
5,621,290 A 4/1997 Heller et al.
5,636,801 A 6/1997 Kroger
5,655,725 A 8/1997 Kroger
5,662,280 A 9/1997 Nishio et al.
5,667,152 A 9/1997 Mooring
5,680,999 A 10/1997 Wada
5,704,776 A 1/1998 Sher
5,724,737 A 3/1998 Stones
5,775,605 A 7/1998 Tsai
5,788,476 A 8/1998 Sher
5,829,697 A 11/1998 Kroger
5,829,963 A 11/1998 Ichikawa
5,850,342 A 12/1998 Nakamura et al.
5,868,242 A 2/1999 Hall et al.
5,884,855 A 3/1999 Chang
5,897,065 A 4/1999 Schwelling
5,921,367 A 7/1999 Kashioka et al.
D412,716 S 8/1999 Kroger
5,942,975 A 8/1999 Sorensen
5,988,542 A 11/1999 Henreckson et al.
6,065,696 A 5/2000 Tsai
6,079,645 A 6/2000 Henreckson et al.
6,082,643 A 7/2000 Kovacs
6,082,644 A 7/2000 Turner
6,089,482 A 7/2000 Chang
6,113,017 A 9/2000 Tsai
6,116,528 A 9/2000 Schwelling
6,247,828 B1 6/2001 Herst
D444,809 S 7/2001 Chang
6,260,780 B1 7/2001 Kroger et al.
6,265,682 B1 7/2001 Lee
6,274,828 B1 8/2001 Chu
6,308,904 B1 10/2001 Chang
6,325,309 B1 12/2001 Chang
6,340,124 B1 1/2002 Charles et al.
6,376,939 B1 4/2002 Suzuki et al.
6,390,397 B1 * 5/2002 Ko ..... 241/34
6,418,004 B1 7/2002 Mather et al.
6,501,198 B2 12/2002 Taylor et al.
6,536,536 B1 3/2003 Gass et al.
6,550,701 B1 4/2003 Chang
6,575,285 B2 6/2003 Jong
D481,416 S 10/2003 Chang
6,629,654 B2 10/2003 Neely et al.
6,655,943 B1 12/2003 Peterson et al.
6,676,050 B2 1/2004 Chang
6,676,460 B1 1/2004 Motsenbocker
6,724,324 B1 4/2004 Lambert
D494,607 S 8/2004 Hunag
6,775,018 B1 8/2004 Taniguchi
6,779,747 B2 8/2004 McLean et al.
6,813,983 B2 11/2004 Gass et al.
6,822,698 B2 11/2004 Clapper
6,826,988 B2 12/2004 Gass et al.
6,834,730 B2 12/2004 Gass et al.
6,857,345 B2 2/2005 Gass et al.
D502,713 S 3/2005 Hunag

| | | | | |
|---|---|---|---|---|
| D502,714 | S | 3/2005 | Hunag | |
| 6,877,410 | B2 | 4/2005 | Gass et al. | |
| 6,880,440 | B2 | 4/2005 | Gass et al. | |
| 6,920,814 | B2 | 7/2005 | Gass et al. | |
| 6,922,153 | B2 | 7/2005 | Pierga et al. | |
| 6,945,148 | B2 | 9/2005 | Gass et al. | |
| 6,945,149 | B2 | 9/2005 | Gass et al. | |
| 6,957,601 | B2 | 10/2005 | Gass et al. | |
| 6,962,301 | B1 | 11/2005 | Chang | |
| 6,966,513 | B2 | 11/2005 | Chang | |
| 6,976,648 | B2 | 12/2005 | Chang | |
| 6,978,954 | B2 | 12/2005 | Kroger et al. | |
| 6,979,813 | B2 | 12/2005 | Avril | |
| 6,981,667 | B2 | 1/2006 | Hunag | |
| 6,983,903 | B2 | 1/2006 | Chang | |
| 6,994,004 | B2 | 2/2006 | Gass et al. | |
| 6,997,090 | B2 | 2/2006 | Gass et al. | |
| 7,000,514 | B2 | 2/2006 | Gass et al. | |
| 7,024,975 | B2 | 4/2006 | Gass et al. | |
| 7,040,559 | B2 | 5/2006 | Matlin et al. | |
| 7,044,410 | B2 | 5/2006 | Hunag | |
| 7,048,218 | B2 | 5/2006 | Hunag | |
| 7,055,417 | B1 | 6/2006 | Gass | |
| 7,077,039 | B2 | 7/2006 | Gass et al. | |
| 7,083,129 | B2 | 8/2006 | Beam, III | |
| 7,093,668 | B2 | 8/2006 | Gass et al. | |
| 7,098,800 | B2 | 8/2006 | Gass | |
| 7,100,483 | B2 | 9/2006 | Gass et al. | |
| 7,121,358 | B2 | 10/2006 | Gass et al. | |
| 7,137,326 | B2 | 11/2006 | Gass et al. | |
| 7,150,422 | B2 | 12/2006 | Wang | |
| 7,171,879 | B2 | 2/2007 | Gass et al. | |
| 7,171,897 | B2 | 2/2007 | Gass et al. | |
| 7,195,185 | B2 | 3/2007 | Matlin | |
| 7,197,969 | B2 | 4/2007 | Gass et al. | |
| 7,210,383 | B2 | 5/2007 | Gass et al | |
| 7,225,712 | B2 | 6/2007 | Gass et al. | |
| 7,228,772 | B2 | 6/2007 | Gass | |
| 7,231,856 | B2 | 6/2007 | Gass et al. | |
| 7,284,467 | B2 | 10/2007 | Gass et al. | |
| 7,290,472 | B2 | 11/2007 | Gass et al. | |
| 7,308,843 | B2 | 12/2007 | Gass et al. | |
| 7,311,276 | B2 | 12/2007 | Matlin et al. | |
| 7,328,752 | B2 | 2/2008 | Gass et al. | |
| 7,344,096 | B2 | 3/2008 | Matlin et al. | |
| D583,859 | S | 12/2008 | Holderfield et al. | |
| D584,342 | S | 1/2009 | Parratt et al. | |
| D591,335 | S | 4/2009 | Holderfield et al. | |
| 7,631,822 | B2 | 12/2009 | Matlin et al. | |
| 7,631,823 | B2 | 12/2009 | Matlin et al. | |
| 7,631,824 | B2 | 12/2009 | Matlin et al. | |
| 7,635,102 | B2 | 12/2009 | Matlin et al. | |
| 7,871,027 | B2 * | 1/2011 | Ko | 241/100 |
| 2001/0030114 | A1 | 10/2001 | Thielman | |
| 2002/0002062 | A1 | 1/2002 | Itazu et al. | |
| 2002/0002942 | A1 | 1/2002 | Abraham et al. | |
| 2002/0017175 | A1 | 2/2002 | Gass et al. | |
| 2002/0017176 | A1 | 2/2002 | Gass et al. | |
| 2002/0017178 | A1 | 2/2002 | Gass et al. | |
| 2002/0017179 | A1 | 2/2002 | Gass et al. | |
| 2002/0017180 | A1 | 2/2002 | Gass et al. | |
| 2002/0017181 | A1 | 2/2002 | Gass et al. | |
| 2002/0017182 | A1 | 2/2002 | Gass et al. | |
| 2002/0017183 | A1 | 2/2002 | Gass et al. | |
| 2002/0017184 | A1 | 2/2002 | Gass et al. | |
| 2002/0017336 | A1 | 2/2002 | Gass et al. | |
| 2002/0020261 | A1 | 2/2002 | Gass et al. | |
| 2002/0020263 | A1 | 2/2002 | Gass et al. | |
| 2002/0020265 | A1 | 2/2002 | Gass et al. | |
| 2002/0056348 | A1 | 5/2002 | Gass et al. | |
| 2002/0056349 | A1 | 5/2002 | Gass et al. | |
| 2002/0056350 | A1 | 5/2002 | Gass et al. | |
| 2002/0059853 | A1 | 5/2002 | Gass et al. | |
| 2002/0059854 | A1 | 5/2002 | Gass et al. | |
| 2002/0059855 | A1 | 5/2002 | Gass et al. | |
| 2002/0066346 | A1 | 6/2002 | Gass et al. | |
| 2002/0069734 | A1 | 6/2002 | Gass et al. | |
| 2002/0111702 | A1 | 8/2002 | Angel | |
| 2002/0139877 | A1 | 10/2002 | Beam, III | |
| 2002/0170399 | A1 | 11/2002 | Gass et al. | |
| 2002/0170400 | A1 | 11/2002 | Gass et al. | |
| 2002/0190581 | A1 | 12/2002 | Gass et al. | |
| 2003/0002942 | A1 | 1/2003 | Gass et al. | |
| 2003/0005588 | A1 | 1/2003 | Gass et al. | |
| 2003/0015253 | A1 | 1/2003 | Gass et al. | |
| 2003/0019341 | A1 | 1/2003 | Gass et al. | |
| 2003/0037651 | A1 | 2/2003 | Gass et al. | |
| 2003/0056853 | A1 | 3/2003 | Gass et al. | |
| 2003/0058121 | A1 | 3/2003 | Gass et al. | |
| 2003/0090224 | A1 | 5/2003 | Gass et al. | |
| 2003/0090226 | A1 | 5/2003 | Chen et al. | |
| 2003/0196824 | A1 | 10/2003 | Gass et al. | |
| 2004/0008122 | A1 | 1/2004 | Michael | |
| 2004/0040426 | A1 | 3/2004 | Gass et al. | |
| 2004/0043696 | A1 | 3/2004 | Suzuki | |
| 2004/0163514 | A1 | 8/2004 | Gass et al. | |
| 2004/0173430 | A1 | 9/2004 | Gass | |
| 2004/0181951 | A1 | 9/2004 | Wittke | |
| 2004/0194594 | A1 | 10/2004 | Dils et al. | |
| 2004/0226800 | A1 | 11/2004 | Pierga et al. | |
| 2005/0039586 | A1 | 2/2005 | Gass et al. | |
| 2005/0039822 | A1 | 2/2005 | Gass et al. | |
| 2005/0041359 | A1 | 2/2005 | Gass | |
| 2005/0132859 | A1 | 6/2005 | Hunag | |
| 2005/0157203 | A1 | 7/2005 | Nakakuki et al. | |
| 2005/0166736 | A1 | 8/2005 | Gass et al. | |
| 2005/0218250 | A1 | 10/2005 | Matlin et al. | |
| 2005/0274834 | A1 | 12/2005 | Huang | |
| 2005/0274836 | A1 | 12/2005 | Chang | |
| 2006/0091247 | A1 | 5/2006 | Matlin | |
| 2006/0157600 | A1 | 7/2006 | Wang | |
| 2006/0169619 | A1 | 8/2006 | Wang | |
| 2006/0249609 | A1 | 11/2006 | Huang | |
| 2007/0176033 | A1 * | 8/2007 | Omi | 241/225 |
| 2008/0210794 | A1 * | 9/2008 | Schwelling et al. | 241/225 |

FOREIGN PATENT DOCUMENTS

| | | |
|---|---|---|
| CN | 2383583 | 6/2000 |
| DE | 7818838 | 11/1979 |
| DE | 3208676 | 10/1982 |
| DE | 3247299 | 7/1984 |
| DE | 3313232 | 10/1984 |
| DE | 222515 | 5/1985 |
| DE | 3540896 | 5/1987 |
| DE | 3733413 | 4/1988 |
| DE | 8619856 | 9/1988 |
| DE | 8619856.4 | 9/1988 |
| DE | 3819285 | 12/1989 |
| DE | 4014669 | 11/1991 |
| DE | 4121330 | 1/1993 |
| DE | 19519858 | 12/1996 |
| DE | 19703575 | 8/1998 |
| DE | 199-60267 | 7/2000 |
| EP | 0191137 | 8/1986 |
| EP | 0511535 | 11/1992 |
| EP | 00522071 | 1/1993 |
| EP | 0522071 | 1/1993 |
| EP | 0562076 | 9/1993 |
| EP | 0736886 | 10/1996 |
| EP | 855221 | 7/1998 |
| EP | 0855221 | 7/1998 |
| EP | 1069954 | 1/2001 |
| EP | 1195202 | 4/2002 |
| EP | 1442834 | 8/2004 |
| GB | 761607 | 11/1956 |
| GB | 1132708 | 9/2001 |
| GB | 2096919 | 9/2009 |
| GB | 2199962 | 6/2010 |
| GB | 2203063 | 7/2010 |
| GB | 2234690 | 10/2010 |
| JP | 52011691 | 1/1977 |
| JP | 57076734 | 5/1982 |
| JP | 62146877 | 6/1987 |
| JP | 03143552 | 6/1991 |
| JP | 3143552 | 6/1991 |
| JP | 04110143 | 4/1992 |
| JP | 4110143 | 4/1992 |
| JP | 04157093 | 5/1992 |

| | | | |
|---|---|---|---|
| JP | 04180852 | | 6/1992 |
| JP | 05014164 | | 1/1993 |
| JP | 05068906 | | 3/1993 |
| JP | 05092144 | | 4/1993 |
| JP | 05123593 | | 5/1993 |
| JP | 05211691 | | 8/1993 |
| JP | 05280243 | | 10/1993 |
| JP | 06137104 | | 5/1994 |
| JP | 06277548 | | 10/1994 |
| JP | 07039778 | | 2/1995 |
| JP | 07136539 | | 5/1995 |
| JP | 07155629 | A2 | 6/1995 |
| JP | 07157012 | A2 | 6/1995 |
| JP | 07299377 | A2 | 11/1995 |
| JP | 07328469 | A2 | 12/1995 |
| JP | 8001026 | | 1/1996 |
| JP | 09-075573 | | 3/1997 |
| JP | 09070551 | A2 | 3/1997 |
| JP | 09075763 | A2 | 3/1997 |
| JP | 09139161 | A2 | 5/1997 |
| JP | 09262491 | A2 | 10/1997 |
| JP | 10-089592 | | 1/1998 |
| JP | 10-048344 | | 2/1998 |
| JP | 10034003 | A2 | 2/1998 |
| JP | 10048344 | A2 | 2/1998 |
| JP | 10089592 | A2 | 4/1998 |
| JP | 11216383 | A2 | 8/1999 |
| JP | 2001150383 | A2 | 6/2001 |
| JP | 2001-349139 | | 12/2001 |
| JP | 2004321993 | A2 | 11/2004 |
| JP | 2007-075822 | | 3/2007 |
| WO | WO8403650 | | 9/1984 |
| WO | WO9101860 | | 2/1991 |
| WO | WO92/00159 | | 1/1992 |
| WO | WO9306570 | | 4/1993 |
| WO | WO9308356 | | 4/1993 |
| WO | WO94/13441 | | 6/1994 |
| WO | WO9413441 | | 6/1994 |
| WO | WO9613362 | | 5/1996 |
| WO | WO9637250 | | 11/1996 |
| WO | WO9637350 | | 11/1996 |
| WO | WO9852728 | | 11/1998 |
| WO | WO0048283 | | 8/2000 |
| WO | WO02060588 | | 8/2002 |
| WO | WO02/082613 | | 10/2002 |
| WO | WO03/006213 | | 1/2003 |
| WO | PCT/US2005/028290 | | 8/2005 |
| WO | WO2005/084861 | | 9/2005 |
| WO | WO2005097331 | | 10/2005 |
| WO | WO2005107951 | | 11/2005 |
| WO | WO2006/031324 | | 3/2006 |
| WO | WO2006031324 | | 3/2006 |
| WO | WO2006049784 | | 5/2006 |
| WO | WO2006074122 | | 7/2006 |
| WO | WO2007/060698 | | 5/2007 |
| WO | WO2007/109753 | | 9/2007 |
| WO | WO2008/011517 | | 1/2008 |
| WO | WO2008/014276 | | 1/2008 |
| WO | WO2008/042538 | | 4/2008 |
| WO | WO2008/064392 | | 6/2008 |

OTHER PUBLICATIONS

Industrial Guarding Program Energy Sources Machinery Equipment and Materials, OFSWA Sep. 2002 Version 1.0.
The Limitations of Radiofrequency Presence Sensing Device, US Dept. of Labor, OSHA, Sep. 21, 1987.
Charge-Transfer Touch Sensor, Quantum Research Group Ltd, 2001.
Tom Begnal, Sawstop and bandsaws might soon be an option, Taunton 2008.
Safeguarding woodworking machines and worker safety, tablesaw blade safety device, WOODWEB forum, 2008.
Nils Karlsson, Theory and application of a capacitive sensor for safeguarding in industry, Dept. of Physics and Measurement Techology, Mar. 1994.
J.L. Novak & J.T. Feddema, a capacitance-based proximity sensor for whole arm obstacle avoidance, Sandia National Laboratories Albuquerque NM 87185, Dec. 1992.
D.S. Chauhan & P.H. Dehoff, a magneto-sensitive skin for robots in space, Dept. of Mechanical Engineering & Engineering Science University of North Carolina at Charlotte, Jul. 1991.
Proximity Sensors (book), Festo Didactic, Germany 2003.
Lennart Bavall & Nils Karlsson, capacitive detection of humans for safety in industry- a numerical and experimental investigation, Linkoping Institute of Tech., Sweden Oct. 1997.
Concepts and techniques of machine safeguarding, US Dept. of Labor, OSHA 3067, 1992.
Designing a safe highly productive system, thefabricator.com, May 30, 2002.
Joshua Smith et al, Electric Field Sensing for graphical interfaces, May/Jun. 1998.
TI's Digital signal Controllers put brake on sawstop table saw, www.embeddedstar.com, 2005.
Doubled productivity reduced product damage, Gorbel Inc., 2003.

* cited by examiner

AUTOMATIC SHREDDER WITHOUT CHOOSING THE NUMBER OF PAPER TO BE SHREDDED

TECHNOLOGY FIELD

The present invention relates to the field of shredders, especially to the field of automatic shredders, in particular to an automatic shredder without choosing the number of paper to be shredded.

BACKGROUND TECHNOLOGY

At present, the principle of the automatic paper feeding device of the known automatic shredders is same to that of the pick-up box of printers. When a stack of clean and orderly white paper is laid in the paper tray, the pick-up mechanism would feed the end of the topmost or bottommost sheet of the stack of paper to the knife edges of the shredder with devices like gears, cams, shift levers or pulleys, and this process will be repeated continuously till the stack of paper are shredded completely. As shown in FIG. 1*a* and FIG. 1*b*, the paper support board 11 is fixed aslant above the cutting blades 12, transmission devices like gears, cams, shift levers or pulleys are used to cause the pick-up roller 13 to feed paper so as to move the end 14 of each piece of paper forwards and into the cutting blades 12 in turn to be shredded. Wherein the pick-up roller 13 is a smooth belt or a rubber roller with teeth, and located above or below the paper support board 11.

There also has the known built-in auto-feed which has a pair of very complex bisecting lids, gravity press devices and a paper tray, two roller assemblies are provided under the bottom of a stack of paper and at opposing sides above and parallel to the cutter shafts, with the two roller assemblies parallel to each other and rotating towards each other at a same speed, paper would be half-folded and fed into the cutter shafts to be shredded. As shown in FIG. 2, two pick-up rollers 15 are located exactly above the central axis of the cutting blades 16, the bisecting gravity adjustment devices composed of upper pick-up rollers 17 and pressboards 18 are provided at the upper part of the paper tray, and the paper feeding movement should make sure the balanced and exact design of the paper feeding speed and the shredding speed. The outer diameters, the surface roughness and the moving speeds of the two pick-up rollers 15 should be same absolutely; and at the same time the gravities of two groups each composed of one of the upper pick-up rollers 17 and one of the pressboards 18 should also be same, then half-folding paper 19 can be achieved.

The first application discussed above is the most common, and the structure is relatively simple. Though its principle is same to that of printers, the stack of paper to be shredded by shredders is unlike the paper used in printers, has tilted corners, and has many waste files the pieces of paper of each of which are bound into a stack, thus the situation that with the automatic shredder bought to shred paper the number of paper should be chosen occurs. And there often occurs the situation that the shredder is smooth on trial when the user wants to buy it, but in normal uses paper jams and can not be taken out, and the pick-up mechanism would be broken if the paper is taken out forcely. Such a situation limits severely the application of these automatic shredders.

The latter known built-in auto-feed can better achieve the function of feeding paper, but the gravity press structure and the pick-up structure of the pair of rollers are too complicated, the pair of rollers and the cutter shafts are designed integratedly, the feeding speed and the shredding speed should be balanced precisely, and the original shredding rhythm would be disrupted when a stack of paper with pins or staples is shredded, moreover these shredders are made to be very large and costly. Thus the application of these shredders is also limited.

In addition, the sizes of the cutting blades, the strength of the cutter shaft the cutting blades are mounted on, and the load of the driving motor of one shredder restrict the largest number of paper the shredder can accommodate at a single time. For example, 3, 5, 8, 10, 12, 20 and so on are indicated on the shredder panel, then when the number of paper to be shredded is more than the above limited number, the paper can only be counted and divided into several stacks to be shredded one by one manually, even if the shredder has the function of shredding pins or staples, the pieces of paper also should be disconnected and counted to be divided into several stacks each less than the predetermined largest number to be fed. The number indicated is bigger, the size of the motor and the cutting blades are bigger, and then the cost pressure is greater.

DISCLOSURE OF THE INVENTION

Aspects of the present invention generally pertain to an automatic shredder without choosing the number of paper to be shredded, which comprises an automatic paper feeding device without choosing the thickness of paper to be shredded that can shred a stack of paper with pins or staples, so the shredder can deal with a very large amount of paper to be shredded at one time, has a simple and convenient operation, is designed dexterously, and has a concise structure and a economical cost.

In order to realize the above aims, the automatic shredder without choosing the number of paper to be shredded has the following structures:

In an aspect, the automatic shredder without choosing the number of paper to be shredded comprises a shredder core and an automatic paper feeding device fixed on the shredder core, the automatic paper feeding device comprises a driving mechanism, a paper support box, a pick-up mechanism and a paper press box covered on the paper support box, the driving mechanism is fixed on the shredder core and connected with the pick-up mechanism for driving the pick-up mechanism, the pick-up mechanism is positioned between the paper press box and the paper support box, and fixed to the paper support box to divide the paper support box to be a first zone and a second zone, and its paper feeding direction is towards the second zone, one end of the paper press box is pivoted with the paper support box, the other end of the paper press box is connected detachable with the paper support box, the paper support box is fixed on the shredder core, and the second zone has a paper inlet positioned above the blade assembly of the shredder core.

In a further aspect, the pick-up mechanism comprises a paper press axle, an elastic component and a pick-up axle, the paper press axle is mounted in the paper press box, the elastic component is positioned in the paper press box and props against the paper press box and the paper press axle respectively, or two ends of the elastic component are connected with the paper press box and the shredder core respectively, for pressing the paper press axle towards the pick-up axle which is mounted in the paper support box, the paper press axle is adjacent to the pick-up axle, and the driving mechanism is connected with the pick-up axle for driving the pick-up axle.

In yet another aspect, the driving mechanism comprises a pick-up gear, a transmission gear and a blade shaft gear, the pick-up gear is mounted on the pick-up axle, the blade shaft gear is fixed on the blade shaft of the blade assembly, and the transmission gear is pivoted with the shredder core and engages with the blade shaft gear and the pick-up gear respectively.

In yet another aspect, the pick-up axle has a texture on its surface; or around the pick-up axle is mounted a pick-up roller, and around the paper press axle is mounted a paper press roller next to the pick-up roller.

In yet another aspect, in the middle part of the paper support box there is a groove in which the pick-up axle is located, the top of the cross section of the pick-up axle is as high as the first zone, and/or the elastic component is an iron spring, a rubber spring or a linkage structure.

In a further aspect, the automatic paper feeding device further comprises a magnet which is positioned in the outer side of the first zone of the paper support board.

In a further aspect, the paper press box further has a CD inlet and a manual paper inlet, the CD inlet is above the paper inlet, the second zone has a manual paper entrance above which the manual paper inlet is located and which is above a cutter assembly of the shredder core.

In a further aspect, the automatic shredder further comprises an elastic paper press and retaining device mounted inside the paper press box and extending to the first zone for pressing tightly and retaining the paper in the automatic paper feeding device during the process of shredding paper.

In yet another aspect, the elastic paper press and retaining device is an elastic paper press and retaining board or an elastic paper press and retaining spring flake.

In a further aspect, the automatic paper feeding device is arranged aslant relative to the blade shaft of the blade assembly.

With the present invention, because the pick-up axle of the automatic paper feeding device of the present invention is driven by the blade shaft gear of the blade assembly to rotate the pick-up roller, the bottommost sheet of the stack of paper is moved forwards by the friction of the pick-up roller and then pulled into the blade assembly by the knifepoints at the paper inlet to be shredded, so as to achieve feeding paper automatically, when a stack of paper with pins or staples exists, due to the pressure of the paper press box or the elastic paper press and retaining device mounted on the paper press box, the bottommost sheet of the stack of paper rolled up is pulled into the blade assembly by the knifepoints, and its bookbinding side is removed by the outer end of the paper press box or rolled up to the elastic paper press and retaining device to be torn off from the stack of paper, so as to achieve shredding paper without choosing the number of paper to be shredded, and a stack of paper can be placed into the paper support box at one time without the need of counting the number of paper, even the stack of paper with pins or staples can be shredded, thus various application problems of the above mentioned shredders are solved, so the automatic shredder without choosing the number of paper to be shredded can deal with a very large amount of paper to be shredded at one time, has a simple and convenient operation, is designed dexterously, and has a concise structure and a economical cost.

PREFERRED EMBODIMENTS OF THE INVENTION

Figure 1A:
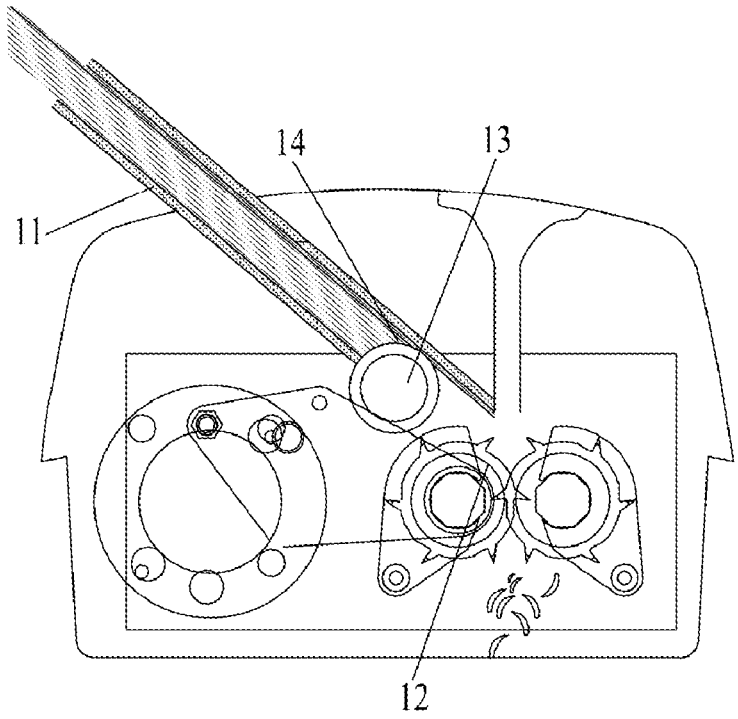
FIG. 1*a* is a schematic view of one structural principle of traditional automatic shredders.
Figure 1B:
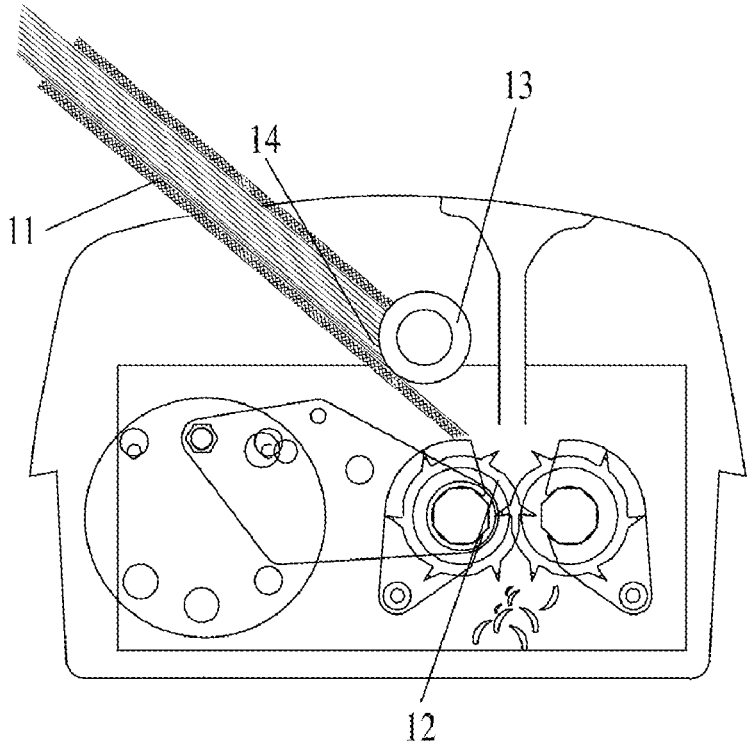
FIG. 1*b* is a schematic view of another structural principle of traditional automatic shredders.
Figure 2:
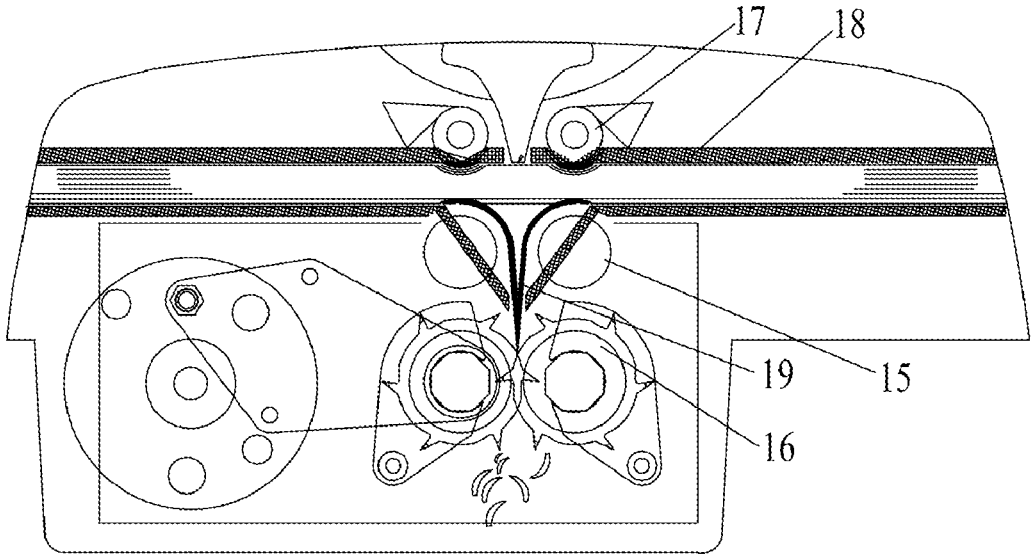
FIG. 2 is a schematic view of another structural principle of traditional automatic shredders.
Figure 3:
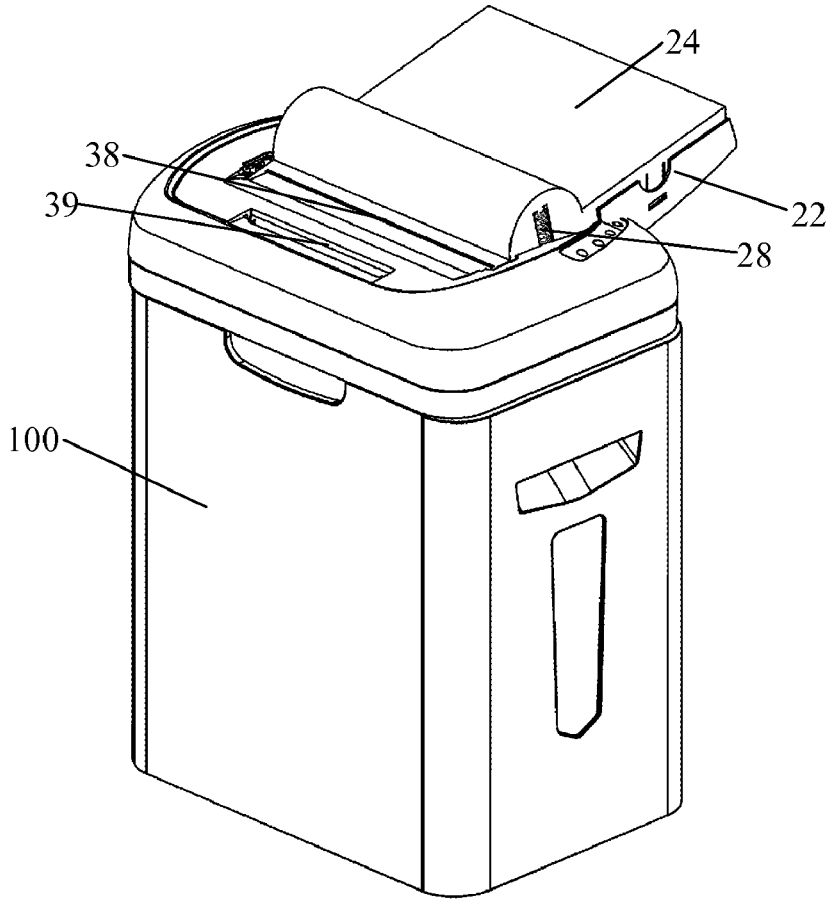
FIG. 3 is a stereogram of the structure of one embodiment of the present invention.
Figure 4:
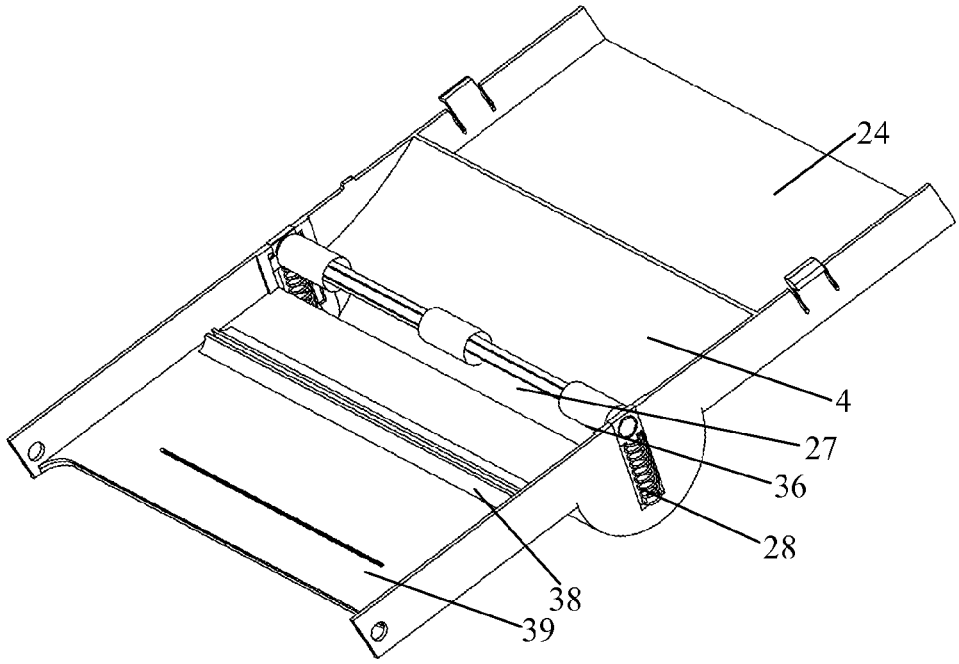
FIG. 4 is a stereogram of the structure of the paper press box, the elastic paper press and retaining device, the elastic component, the paper press axle and the paper press roller of the embodiment shown in FIG. 3 assembled together.
Figure 5:
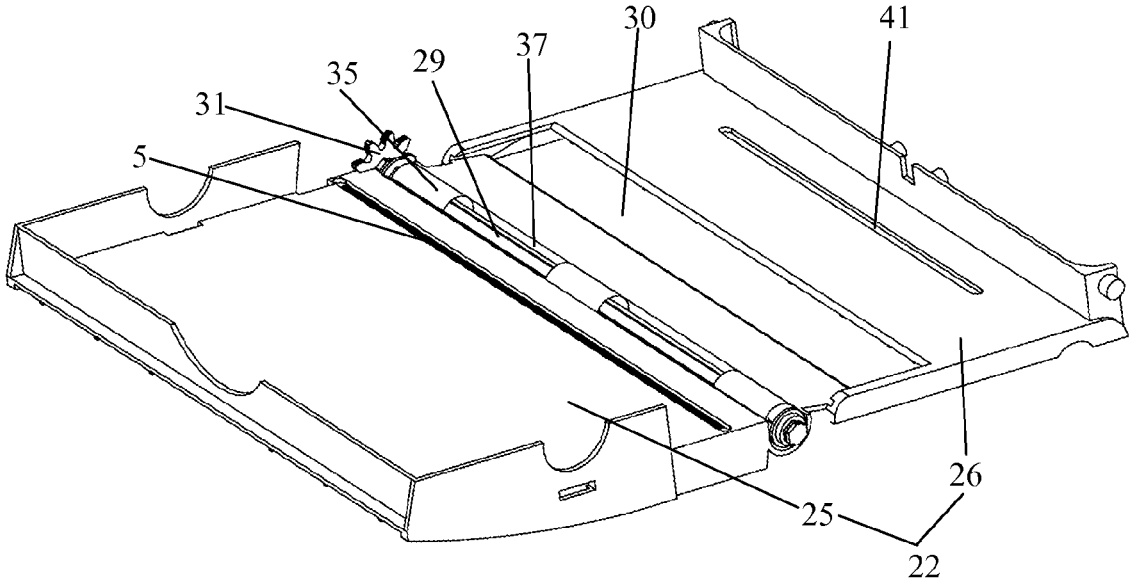
FIG. 5 is a stereogram of the structure of the paper support box, the pick-up axle, the pick-up roller and the magnet of the embodiment shown in FIG. 3 assembled together.
Figure 6:
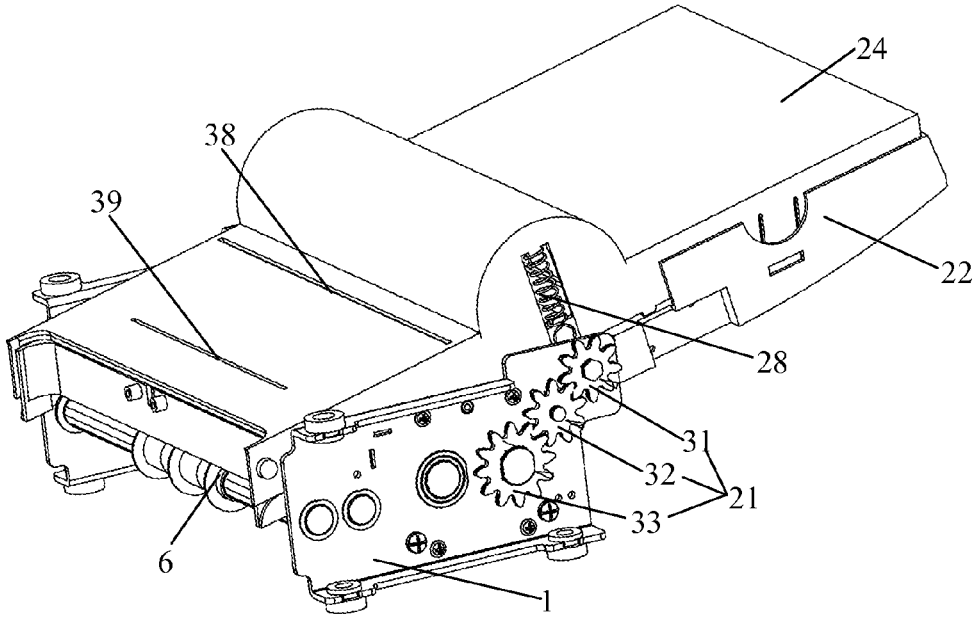
FIG. 6 is a stereogram of the structure of the automatic paper feeding device and the shredder core of the embodiment shown in FIG. 3 assembled together.
Figure 7:
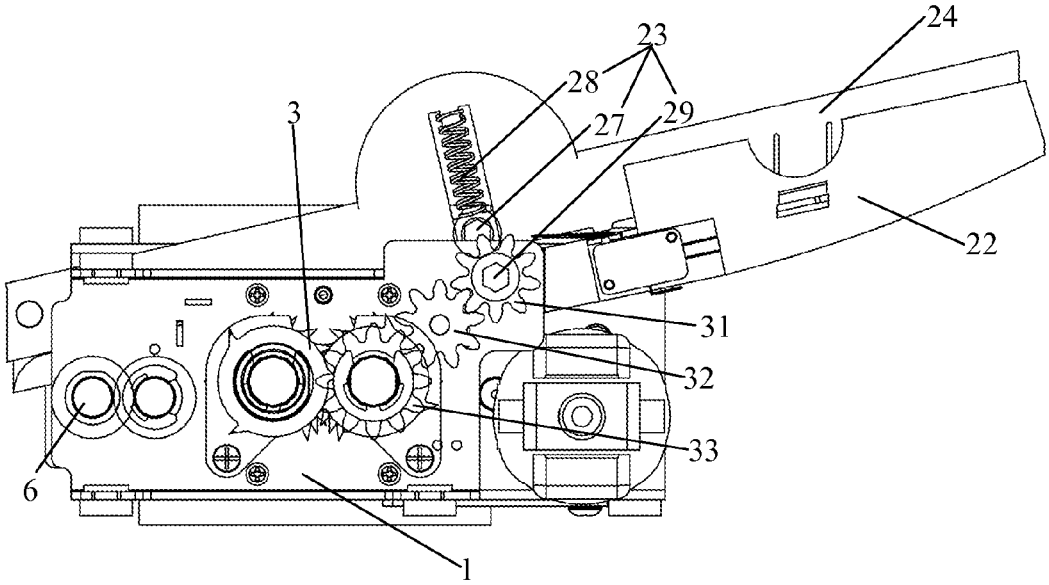
FIG. 7 is a partial perspective front view of the structure of the automatic paper feeding device and the shredder core of the embodiment shown in FIG. 3 assembled together.
Figure 8:
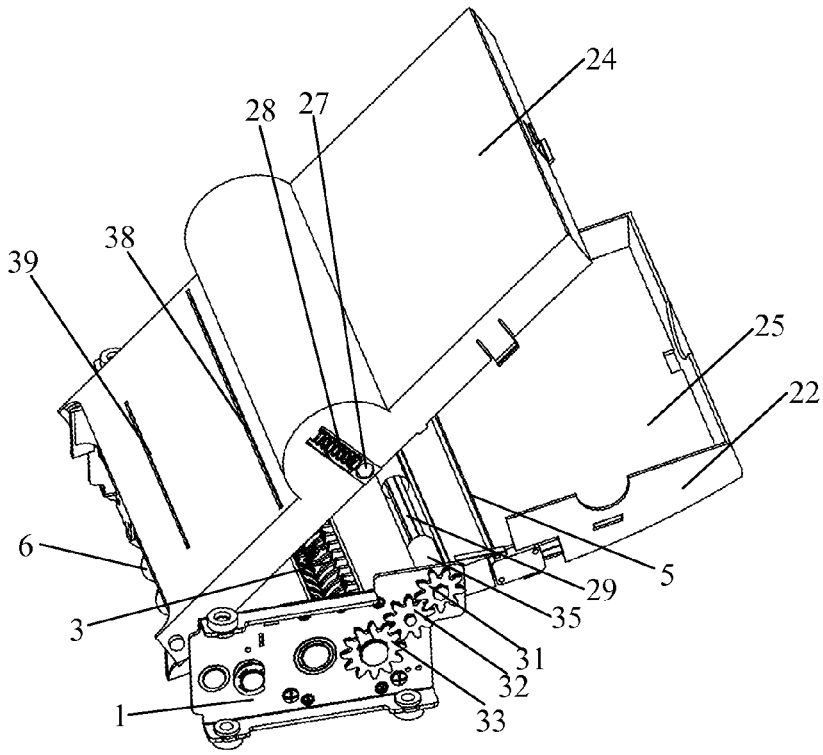
FIG. 8 is a stereogram of the structure of the automatic paper feeding device mounted on the shredder core of the embodiment shown in FIG. 3 opened.

In order to understand the technical content of the present invention more clearly, the present invention would be exemplified further by reference to the following embodiments. Wherein the same component name adopts the same reference sign.

Please refer to FIGS. 3~9 showing an embodiment of the automatic shredder without choosing the number of paper to be shredded of the present invention which comprises a shredder core 1, an elastic paper press and retaining device 4 and an automatic paper feeding device fixed on the shredder core 1, the automatic paper feeding device comprises a driving mechanism 21, a paper support box 22, a pick-up mechanism 23 and a paper press box 24 covered on the paper support box 22, the driving mechanism 21 is fixed on the shredder core 1 and connected with the pick-up mechanism 23 for driving the pick-up mechanism 23, the pick-up mechanism 23 is positioned between the paper press box 24 and the paper support box 22, and fixed to the paper support box 22 to divide the paper support box 22 to be a first zone 25 and a second zone 26, and its paper feeding direction is towards the second zone 26, the elastic paper press and retaining device 4 is fixed inside the paper press box 24 and extends to the first zone 25, one end of the paper press box 24 is pivoted with the paper support box 22, the other end of the paper press box 24 is connected detachable with the paper support box 22, the paper support box 22 is fixed on the shredder core 1, and the second zone 26 has a paper inlet 30 positioned above the blade assembly 3 of the shredder core 1.

The pick-up mechanism 23 comprises a paper press axle 27, an elastic component 28 and a pick-up axle 29, the paper press axle 27 is mounted in the paper press box 24, the elastic component 28 is positioned in the paper press box 24 and props against the paper press box 24 and the paper press axle 27 respectively, for pressing the paper press axle 27 towards the pick-up axle 29 which is mounted in the paper support box 22, the paper press axle 27 is adjacent to the pick-up axle 29, and the driving mechanism 21 is connected with the pick-up axle 29 for driving the pick-up axle 29. Here, the elastic component 28 can be an iron spring, a rubber spring or a linkage structure.

A stack of paper can be placed in the paper support box 22, the paper press box 24 is mounted inside the shredder housing 100 and on the paper support box 22, and the paper support box 22 and the paper press box 24 can be connected detachable by blocking each other, they also can be combined with the turnover lid structure to be mounted to the upper lid of the whole machine, because the elastic paper press and retaining device 4 mounted on the paper press box 24 has a change in elasticity related to the thickness of the stack of paper, and forms a clamping device with the paper support box 22 to maintain a suitable clamping force to the stack of paper on the paper support box 22, and to retain the stack of paper rolled up due to pins or staples so as to cause the bottommost sheet of the stack of paper rolled up to be pulled into the blades by the knifepoints, and its binding side is rolled up to the elastic paper press and retaining device 4 to be torn off from the stack of paper, so as to achieve the function of not choosing the number of paper to be shredded in shredding paper with pins or staples. The above mentioned driving mechanism 21 can adopt traditional means such as motors to drive the pick-up mechanism 23, and the better means will be described hereinafter.

Figure 10:
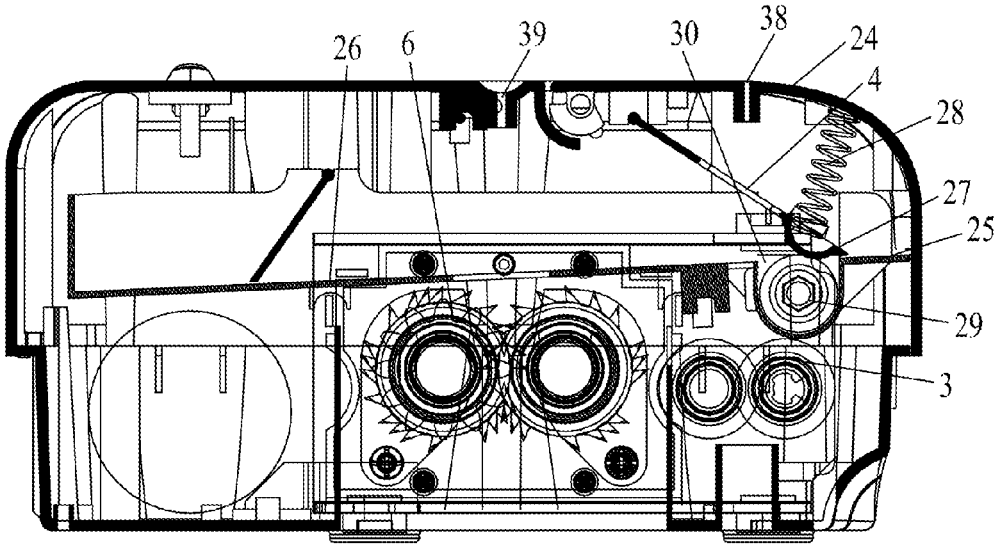
FIG. 10 is a perspective cutaway schematic view of another embodiment of the present invention.
Figure 11:
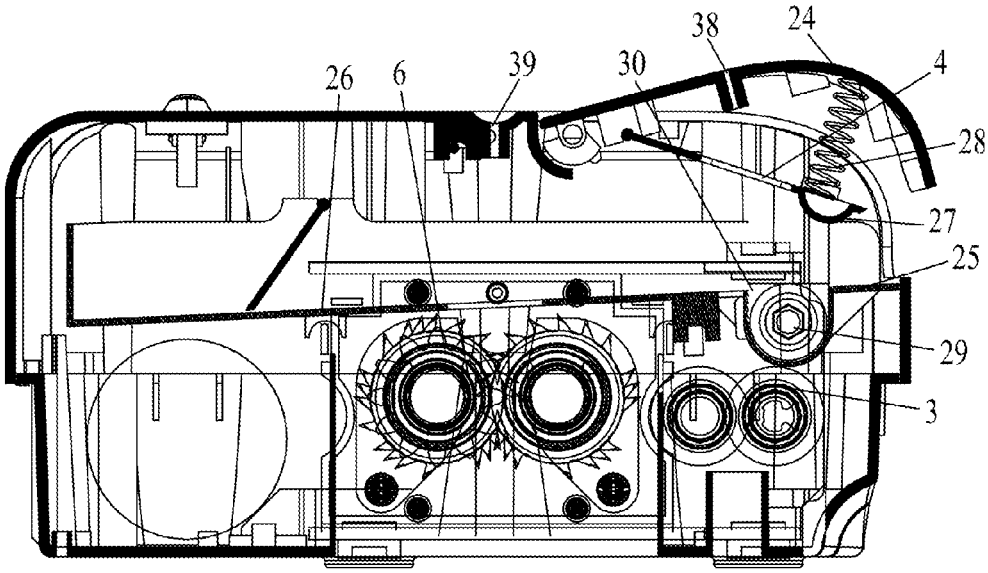
FIG. 11 is a schematic view of the paper press box of the embodiment shown in FIG. 10 opened.

In the present embodiment, the elastic paper press and retaining device 4 is an elastic paper press and retaining spring flake. Please refer to FIGS. 10~11, the elastic paper press and retaining device 4 can also be an elastic paper press and retaining board, and the paper press axle 27 is arranged in the elastic paper press and retaining board which is pivoted with the paper press box 24, therefore the paper press axle 27 is connected indirectly with the paper press box 24 through the elastic paper press and retaining board.

The driving mechanism 21 comprises a pick-up gear 31, a transmission gear 32 and a blade shaft gear 33, the pick-up gear 31 is mounted on the pick-up axle 29, the blade shaft gear 33 is fixed on the blade shaft of the blade assembly 3, the transmission gear 32 is pivoted with the shredder core 1 and engages with the blade shaft gear 33 and the pick-up gear 31 respectively. The pick-up gear 31 is driven by the blade shaft, and the above mentioned gear assembly can make the pick-up axle 31 and the blade shaft rotate in the same direction. Or, the driving mechanism 21 can only comprise a pick-up gear 31 and a blade shaft gear 33, and the pick-up gear 31 engages with the blade shaft gear 33 directly.

More preferably, the pick-up axle 29 has a texture on its surface, for facilitating the feeding of the paper.

Around the pick-up axle 29 is mounted a pick-up roller 35, around the paper press axle 27 is mounted a paper press roller 36 next to the pick-up roller 35. Optionally, no pick-up roller 35 is mounted around the pick-up axle 29, and the pick-up axle 29 can have a texture on its surface, for facilitating the feeding of the paper, also no paper press roller 36 is mounted around the paper press axle 27, and the paper press axle 27 can have a texture on its surface.

The paper press roller 36 and the pick-up roller 35 can be rubber pieces with a rubber-like elasticity and a texture surface or other parts with a similar elastic function, at the same time the rollers can further cove the whole axles basically to form axles whose rigid axle cores coated by rubber layers and which can feed paper with any part of them. If two or more pieces of paper are designed to be pulled into the knifepoints at a single time, the surfaces of the rollers can be processed to have a texture with teeth like the surface of the rollers in printers. The length of the elastic component 28 can be adjusted properly during the core design stage so that different pieces of paper, such as 100, 200, 300, 500, 800 and so on, can be shredded at one time. The elasticity of the elastic component 28 and the friction force of the pick-up roller 35 are set to guarantee the feeding of paper with different thickness.

Through the precise gear transmission ratio and the precise ratio of the outer diameters of the blades and the pick-up roller 35, it is guaranteed that the speed of shredding one piece of paper is slightly larger than the paper feeding speed, so that there is an interval in time and space between two times of paper feeding so as to reduce the occurrence of paper jam; at the same time the rhythm of feeding paper and shredding paper would not be disrupted when the speed of the whole machine decreases in shredding a stack of paper with pins or staples.

In the middle part of the paper support box 22 is there a groove 37 in which the pick-up axle 29 is located, and the top of the cross section of the pick-up axle 29 is as high as the first zone 25.

The automatic paper feeding device further comprises a magnet 5 which is positioned in the first zone 25 and corresponding to the elastic paper press and retaining device 4. Particularly, the magnet 5 is a magnetic strip which is embedded in the first zone 25. The magnet 5 can hold pins or staples to prevent them from entering into the machine by mistake to cause short circuit, jam completely or scratch the pick-up mechanism 23. In the shredder core 1 further mounted is a cutter assembly 6, the paper press box 24 further has a CD inlet 38 and a manual paper inlet 39, the CD inlet 38 is above the paper inlet 30, the second zone 26 has a manual paper entrance 41 above which the manual paper inlet 39 is positioned and which is above the cutter assembly 6. Thus the manual paper inlet 39 and the CD inlet 38 are reserved on the paper press box 24 to male the functions of the machine perfectly, and these two functions also can be selected optionally during assembling the shredder.

The automatic paper feeding device is arranged aslant relative to the blade shaft of the blade assembly 3. The automatic paper feeding device arranged aslant can make part of the paper support box 22 used to support the stack of paper to extend outside the shredder, which can be like the turnover or telescopic structures of the paper support board of printers, to make the whole shape of the machine smaller, save more space and streamline parts.

The above mentioned automatic paper feeding device guarantees that a small part of one piece of paper folded in half near the blades can be pulled into the blade assembly by the blades; and the consistency of feeding paper and shredding paper at a single time, i.e. only one single piece of paper is shredded at one time. Then the function of shredding many pieces of paper in which paper with titled corners or curlings is mixed at one time is achieved; the existing of the elastic paper press and retaining device 4 causes that when a stack of paper with pins or staples exists, due to the pressure of the elastic paper press and retaining device 4 mounted on the paper press box 24, the bottommost sheet of the stack of paper rolled up is pulled into the blades by the knifepoints, and its bookbinding side is rolled up to the elastic paper press and retaining device 4 to be torn off from the stack of paper, so as to achieve shredding paper without choosing the number of paper to be shredded.

When the present invention is used, the paper press box 24 is opened to raise the free end of the elastic paper press and retaining device 4, a stack of paper is placed in the paper support box 22, then the paper press box 24 is closed, the elastic component 28 presses the paper press axle 27 to cause the paper press roller 36 on the paper press axle 27 to press the stack of paper, the paper press roller 36 is far away from the pick-up axle 35, the free end of the elastic paper press and retaining device 4 retains and presses the stack of paper, then the machine is started, the blade shaft gear 33 is rotated to drive the pick-up gear 31 to rotate the pick-up roller 35, thus the bottommost sheet of the stack of paper is moved forwards (towards the second zone 26) by the friction of the pick-up roller 35, for one end of the sheet props against the paper support box 22 and can not move, and the sheet is pressed by the stack of paper on it, the sheet can only be folded at the paper inlet 30 towards the cutting blades to be fed not from any end of it to be pulled into the blade assembly by the knifepoints to be shredded. The linear speed of the cutting blades is much larger than that of the pick-up roller 35, so the pick-up roller 35 just feeds one paper a short distance, the blades can tear off the bottommost paper, thus the stack of paper can be shredded completely one by one. And the principle is shown as FIG. 9.

Figure 9:
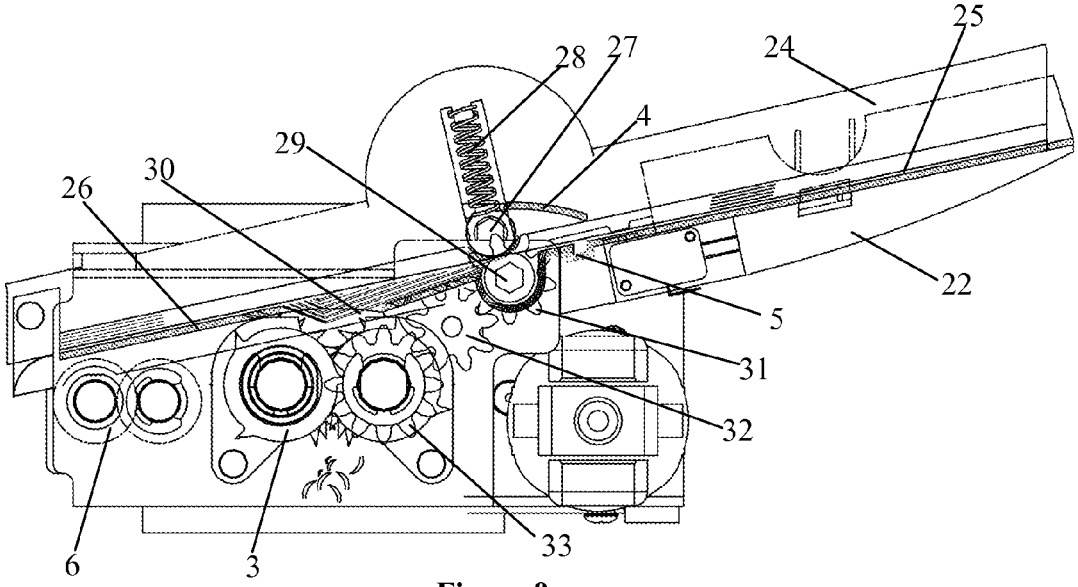
FIG. 9 is a perspective cutaway and working principle schematic view of the structure of the automatic paper feeding device and the shredder core of the embodiment shown in FIG. 3 assembled together.

During feeding a stack of paper with pins or staples, as analyzed in FIG. 9, due to the pressure of the elastic paper press and retaining device 4 mounted on the paper press box 24, the elastic paper press and retaining device 4 and the paper support box 22 clamp the stack of paper together, the bottommost sheet is moved forwards to roll up the stack of paper with pins or staples together, and torn off from the stack of paper at the elastic paper press and retaining device 4, therefore feeding and shredding one piece of paper can be still maintained. In the paper support box 22 and near the pick-up roller 35 arranged is a groove in which a magnetic strip is positioned, thus the pins or staples removed are held in the groove to keep the pick-up roller 35 neat.

Figure 12:
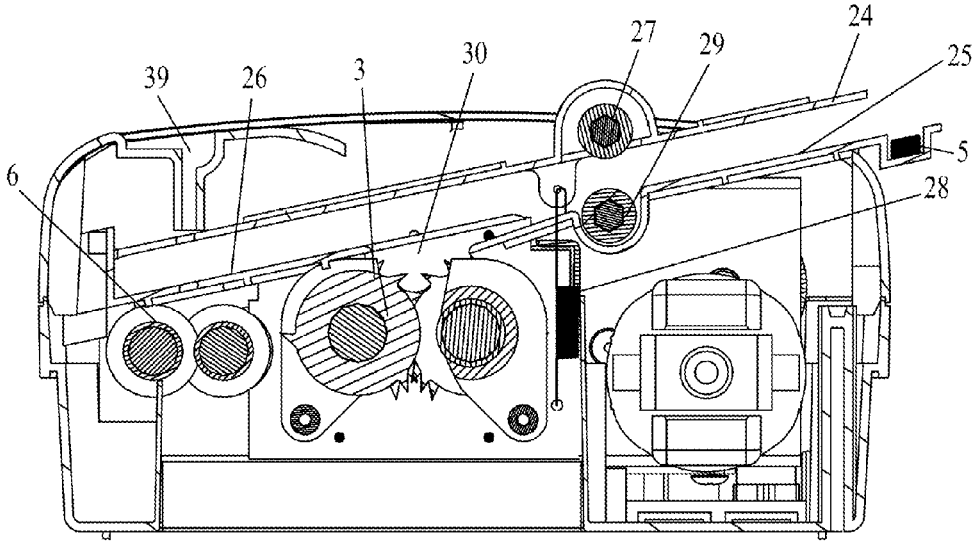
FIG. 12 is a perspective cutaway schematic view of another embodiment of the present invention.
Figure 13:
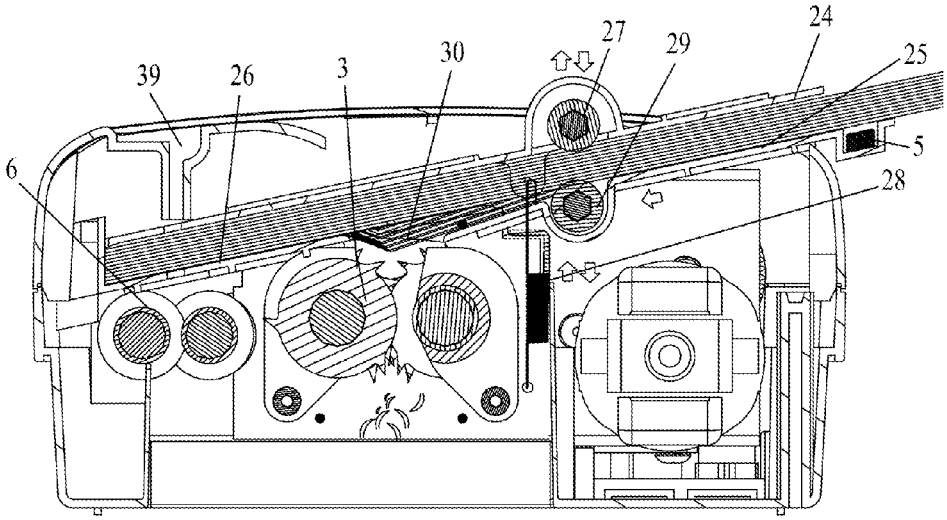
FIG. 13 is a schematic view of the embodiment shown in FIG. 12 in use.

Please refer to FIGS. 12~13 showing another embodiment of the automatic shredder without choosing the number of paper to be shredded of the present invention, the main difference of this embodiment from the two embodiments shown in FIGS. 3~11 is that this embodiment does not have the elastic paper press and retaining device 4, and the paper press box 24 is used directly to press tightly and prop against the stack of paper in the automatic paper feeding device during shredding, the bookbinding side of the stack of paper is removed by the outer end of the paper press box 24, in addition, two ends of the elastic component 28 are connected with the paper press box 24 and the shredder core 1 respectively for pressing the paper press axle 27 towards the pick-up axle 29, and at that time the magnet 5 is located in the outer side of the first zone 25.

The elastic component 28 causes the paper press box 24 and the paper support box 22 to form a clamping device to maintain a suitable clamping force to the stack of paper on the paper support box 22, when the stack of paper with pins or staples is to be shredded, pins or staples can be retained by the outer end of the paper press box 24, the bottommost sheet of the stack of paper is pulled into the blades by the knifepoints, and its bookbinding side is torn off from the stack of paper by the outer end of the paper press box 24, so as to achieve the function of not choosing the number of paper to be shredded in shredding paper with pins or staples.

The present invention can facilitate the user to shred relative more pieces of paper automatically at one time, at the same time save the cost to save energy really.

To sum up, the automatic shredder without choosing the number of paper to be shredded of the present invention comprises an automatic paper feeding device without choosing the thickness of paper to be shredded that can shred a stack of paper with pins or staples, so the shredder can deal with a very large amount of paper to be shredded at one time, has a simple and convenient operation, is designed dexterously, and has a concise structure and a economical cost.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

I claim:

1. The automatic shredder without choosing the number of paper to be shredded, comprising a shredder core and an automatic paper feeding device fixed on the shredder core, wherein the automatic paper feeding device comprises a driving mechanism, a paper support box, a pick-up mechanism and a paper press box covered on the paper support box, wherein the driving mechanism is fixed on the shredder core and connected with the pick-up mechanism for driving the pick-up mechanism, wherein the pick-up mechanism is positioned between the paper press box and the paper support box, and a portion of the pick-up mechanism is fixed to the paper support box to divide the paper support box to be a first zone and a second zone, and its paper feeding direction is towards the second zone, wherein one end of the paper press box is pivoted with the paper support box, the other end of the paper press box is connected detachable with the paper support box, and the paper support box is fixed on the shredder core, and wherein the second zone has a paper inlet positioned above a blade assembly of the shredder core, wherein the pick-up mechanism comprises a paper press axle, an elastic component and a pick-up axle, wherein the paper press axle is mounted in the paper press box, wherein one of the elastic component is positioned in the paper press box and props against the paper press box and the paper press axle respectively, or two ends of the elastic component are connected with the paper press box and the shredder core respectively, wherein the elastic component is for pressing the paper press axle towards the pick-up axle which is fixed and mounted in the paper support box, wherein the paper press axle is adjacent to the pick-up axle, and wherein the driving mechanism is connected with the pick-up axle for driving the pick-up axle.

2. The automatic shredder without choosing the number of paper to be shredded according to claim 1, wherein the driving mechanism comprises a pick-up gear, a transmission gear and a blade shaft gear, wherein the pick-up gear is mounted on the pick-up axle, wherein the blade shaft gear is fixed on the blade shaft of the blade assembly, and wherein the transmission gear is pivoted with the shredder core and engages with the blade shaft gear and the pick-up gear respectively.

3. The automatic shredder without choosing the number of paper to be shredded according to claim 1, wherein one of the pick-up axle has a texture on its surface or around the pick-up axle is mounted a pick-up roller, and wherein around the paper press axle is mounted a paper press roller next to the pick-up roller.

4. The automatic shredder without choosing the number of paper to be shredded according to claim 1, wherein in the middle part of the paper support box there is a groove in which the pick-up axle is located, wherein one of the top of the cross section of the pick-up axle is as high as the first zone, or the elastic component is one of an iron spring, a rubber spring or a linkage structure, or the top of the cross section of the pick-up axle is as high as the first zone, and the elastic component is one of an iron spring, a rubber spring or a linkage structure.

5. An automatic shredder without choosing the number of paper to be shredded, comprising a shredder core and an automatic paper feeding device fixed on the shredder core, wherein the automatic paper feeding device comprises a driving mechanism, a paper support box, a pick-up mechanism and a paper press box covered on the paper support box, wherein the driving mechanism is fixed on the shredder core and connected with the pick-up mechanism for driving the pick-up mechanism, wherein the pick-up mechanism is positioned between the paper press box and the paper support box, and is fixed to the paper support box to divide the paper support box to be a first zone and a second zone, and its paper feeding direction is towards the second zone, wherein one end of the paper press box is pivoted with the paper support box, the other end of the paper press box is connected detachable with the paper support box, wherein the paper support box is fixed on the shredder core, and the second zone has a paper inlet positioned above a blade assembly of the shredder core;

wherein the automatic shredder further comprises an elastic paper press and retaining device mounted inside the paper press box and extending to the first zone for pressing tightly and retaining the paper in the automatic paper feeding device during shredding of paper; and wherein the automatic paper feeding device further comprises a magnet which is positioned in the outer side of the first zone of the paper support board and corresponds to the elastic paper press and retaining device, wherein the pick-up mechanism comprises a paper press axle, an elastic component and a pick-up axle, wherein the paper press axle is mounted in the paper press box, wherein one of the elastic component is positioned in the paper press box and props against the paper press box and the paper press axle respectively, or two ends of the elastic component are connected with the paper press box and the shredder core respectively, wherein the elastic component is for pressing the paper press axle towards the pick-up axle which is mounted in the paper support box, wherein the paper press axle is adjacent to the pick-up axle, and wherein the driving mechanism is connected with the pick-up axle for driving the pick-up axle.

6. The automatic shredder without choosing the number of paper to be shredded according to claim 5, wherein the driving mechanism comprises a pick-up gear, a transmission gear and a blade shaft gear, wherein the pick-up gear is mounted on the pick-up axle, wherein the blade shaft gear is fixed on the blade shaft of the blade assembly, and wherein the transmission gear is pivoted with the shredder core and engages with the blade shaft gear and the pick-up gear respectively.

7. The automatic shredder without choosing the number of paper to be shredded according to claim 5, wherein one of the pick-up axle has a texture on its surface or around the pick-up axle is mounted a pick-up roller, and wherein around the paper press axle is mounted a paper press roller next to the pick-up roller.

8. The automatic shredder without choosing the number of paper to be shredded according to claim 5, wherein in the middle part of the paper support box there is a groove in which the pick-up axle is located, wherein one of the top of the cross section of the pick-up axle is as high as the first zone, or the elastic component is an iron spring, a rubber spring or a linkage structure, or the top of the cross section of the pick-up axle is as high as the first zone and the elastic component is an iron spring, a rubber spring or a linkage structure.

* * * * *